US007563173B2

(12) United States Patent
Chol

(10) Patent No.: US 7,563,173 B2
(45) Date of Patent: Jul. 21, 2009

(54) ADJUSTABLE LENGTH AND TORQUE RESISTANT GOLF SHAFT

(76) Inventor: Kim Chol, 5759-C Winfield Blvd., San Jose, CA (US) 95123

( * ) Notice: Subject to any disclaimer, the term of this patent is extended or adjusted under 35 U.S.C. 154(b) by 370 days.

(21) Appl. No.: 11/499,511

(22) Filed: Aug. 3, 2006

(65) Prior Publication Data

US 2008/0004128 A1 Jan. 3, 2008

Related U.S. Application Data

(60) Provisional application No. 60/818,219, filed on Jun. 30, 2006.

(51) Int. Cl.
*A63B 53/10* (2006.01)
*A63B 53/12* (2006.01)

(52) U.S. Cl. ..... 473/296; 403/377

(58) Field of Classification Search ..... 473/239, 473/296, 298–299; 403/109.1–109.8, 297, 403/377, 379.1–379.6
See application file for complete search history.

(56) References Cited

U.S. PATENT DOCUMENTS 2,107,983 A * 2/1938 Hamilton ..... 473/296
2,475,927 A * 7/1949 Verderber ..... 473/296
5,452,891 A * 9/1995 Thomas ..... 473/294
D363,519 S * 10/1995 Gooden ..... D21/734
5,653,644 A * 8/1997 Jaeckel ..... 473/303
5,679,080 A * 10/1997 Finsterwald ..... 473/206
6,776,724 B1 * 8/2004 Siemsglusz ..... 473/294
7,018,302 B2 * 3/2006 Jacoby ..... 473/294
7,422,526 B2 * 9/2008 Nemeckay ..... 473/296
2006/0028039 A1 * 2/2006 Ernesti ..... 294/65.5

* cited by examiner

*Primary Examiner*—Stephen L. Blau
(74) *Attorney, Agent, or Firm*—Buchanan Ingersoll & Rooney, PC

(57) ABSTRACT

An adjustable golf shaft having an upper shaft member, a lower shaft member and an inner rod. The upper shaft member includes an elongated bore therein with an upper bushing fixed within an upper end of the elongated bore therein. The lower shaft member has an elongated bore therein with a middle bushing fixed within an upper end of the elongated bore therein. The inner rod includes a lower end dimensioned to be fixed to a lower bushing, and an upper end dimensioned to be fixed to the upper bushing. The inner rod is adapted to slide within the middle bushing as the length of the shaft changes.

6 Claims, 7 Drawing Sheets

ADJUSTABLE LENGTH AND TORQUE RESISTANT GOLF SHAFT

CROSS-REFERENCE TO RELATED APPLICATIONS

This application claims priority to U.S. Provisional Application No. 60/818,219, filed Jun. 30, 2006, which is incorporated herein in its entirety.

FIELD OF INVENTION

This invention relates to an adjustable golf shaft and more particularly to an adjustable length and torque resistant golf shaft for a golf putter.

BACKGROUND

The sport of golf is an increasingly popular sport. Much of the tension, and excitement, of any round of golf, surrounds the act of putting, which ordinarily determines the ultimate winner of any round of golf. As a result of its obvious importance to successfully playing the game of golf, the art, or skill, of putting has been the subject of large numbers of instruction manuals, books, magazine articles, and United States patents. A casual observation of professional and amateur golfers, in the acts of putting shows that putting style, including putter grip, player's stance, putter club style, ball position, can be different for each golfer.

In addition, it can be appreciated that physically, every golfer varies greatly in height, weight, and body structure, such that the distance and angle between the ground and the golfer's hands when putting can also vary greatly. Generally speaking, the act of putting does not require unusual strength, or extremely high velocity club swinging, as in the case of driving or iron play. Putting is, rather, an act of finesse and, hopefully, an act as free of physical stress and mental swing correction signals as possible.

Golf clubs available for purchase at most sports stores are readily available in varying degrees of shaft flex and club head shape. The length of the woods and irons of a set of golf clubs are usually approximately standard throughout the golf manufacturing industry, although such clubs may be special ordered with non-standard lengths. Most golfers, however, acquire a standard length set of clubs and modify their stance, grip, and other swing characteristics to optimize their swing action relative to those clubs.

The design of putters is typically viewed as a pursuit of an aesthetically pleasing club that promotes a golfer's confidence in his or her stroke. As such, many putters have been designed irrespective of the mechanics inherent in the putting swing. Furthermore, many putters lack a design that accounts for an individual golfer's characteristics and characteristic playing style (i.e., stance, grip, etc.).

In the case of putters, conventional practice is to provide putters having an overall length of generally about 35", and a conventional lie angle between the shaft and the bottom surface of the putter of approximating 70 degrees. Rarely are putters shortened or lengthened, and typically, the beginner, or intermediate, golfer will adapt his putter swing to the length of the club rather than having a putter personally fitted to him, or her, without any reference to the standard length or lie.

Accordingly, it would be desirable to have a putter with an adjustable length and torque resistant golf shaft, which can easily adjust to various heights and has the appearance of a conventional shaft whose configuration is fixed.

SUMMARY

In accordance with one embodiment, an adjustable golf shaft comprises: an upper shaft member having an elongated bore therein with an upper bushing fixed within an upper end of the elongated bore therein; a lower shaft member having an elongated bore therein with a middle bushing fixed within an upper end of the elongated bore therein; and an inner rod having a lower bushings fixed to a lower end thereof, an upper end of the inner rod is fixed to the upper bushing, and the inner rod is adapted to slide within the middle bushing.

In accordance with another embodiment, a putter comprises: an adjustable shaft comprising: an upper shaft member having an elongated bore therein with an upper bushing fixed within an upper end of the elongated bore therein: a lower shaft member having an elongated bore therein with a middle bushing fixed within an upper end of the elongated bore therein; and an inner rod having a lower bushings fixed to a lower end thereof, an upper end of the inner rod is fixed to the upper bushing, and the inner rod is adapted to slide within the middle bushing; and a putter head.

In accordance with a further embodiment, an adjustable golf shaft comprises: a lower shaft member comprised of an elongated cylindrical bore and inner rod member; and an upper shaft member comprised of an elongated outer cylindrical bore, the outer cylindrical bore housing an elongated cylindrical member having an inner bore, wherein the inner bore is dimensioned to receive the inner rod member and prevents the inner rod member from rotating within the inner bore forming a torque resistant shaft.

DETAILED DESCRIPTION

Figure 1:
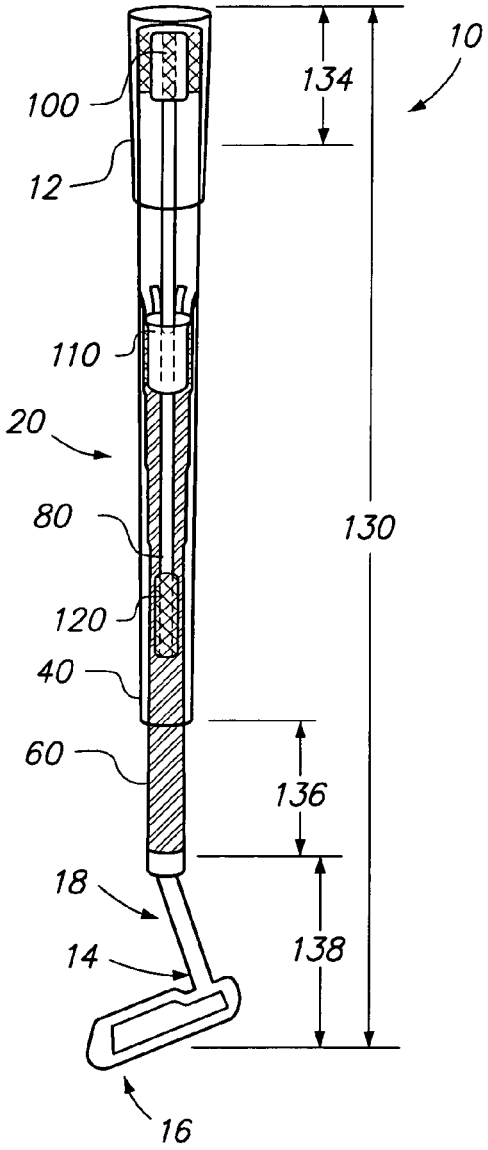
FIG. 1 is a cross sectional view of an adjustable length and torque resistant golf shaft according to one embodiment.

FIG. 1 is a cross sectional view of a putter 10 having an adjustable length and torque resistant golf shaft 20 according to one embodiment. As shown in FIG. 1, the putter 10 includes an adjustable shaft 20, which is comprised of an upper shaft member 40 (or outer shaft member), a lower shaft member 60 (or inner shaft member) and an inner rod 80. The shaft 20 includes an upper bushing 100 fixed within the upper shaft member 40, a middle bushing 110 fixed within the lower shaft member 60 and a lower bushing 120 fixed to the inner rod 80. The putter 10 also includes a grip 12 and a putter head 14. The grip 12 is configured to fit over an upper end of the upper shaft member 40 and extends downward approximately 8 to 14 inches. The inner rod 80 is configured to fit within the upper and lower shaft members 40, 60.

As shown in FIG. 1, the putter 10 preferably has an overall length 130 of between about 27 and 37 inches. The overall length 130 of the putter 10 when fully extended is approximately 37 inches. Meanwhile, the overall length 132 of the putter in a compressed or compact position is preferably approximately 27 inches. Although, the preferable overall length 130 of the putter 10 is between 27 and 37 inches, it can be appreciated that the overall length 130 of the putter can range from 10 to 72 inches and is more preferably between 20 and 44 inches, and most preferably between 27 and 37 inches. The overall length 130 of the putter 10 varies by a differential length 134, 136 of preferably about 10 inches. As shown, the overall length 130 of the putter 10 includes the adjustable shaft 20 and a putter head 14. Typically, putter heads 14 have an overall height 138 of approximately 3 inches, which includes the putter head or ball striking portion 16 and a shaft 18. The shaft 18 extends from the putter head or ball striking portion 16 to the adjustable shaft 20. It can be appreciated that the overall length 130 of the putter 10 can vary and that any reference to specific measurements is for one embodiment of the present invention consisting of a putter 10 having an overall length of between 27 and 37 inches. However, it can be appreciated that the various dimensions, length, diameters and other specific references to any specific measurement can be changed without departing from the present invention.

Figure 2:
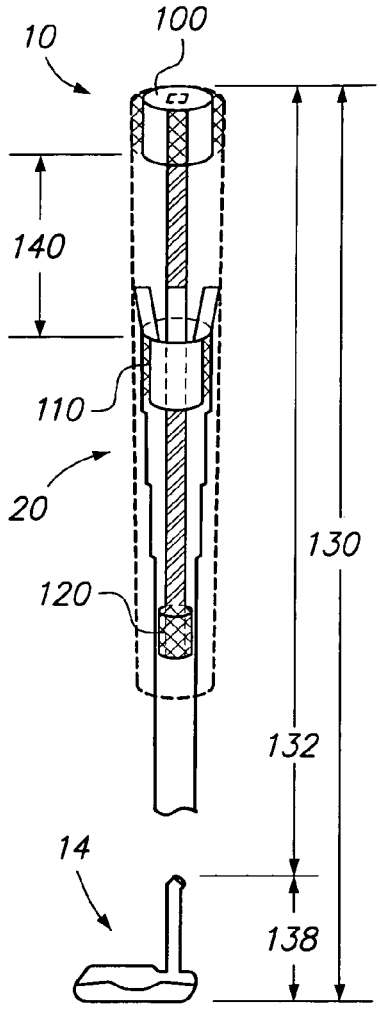
FIG. 2 is a cross sectional view of the adjustable length and torque resistant golf shaft of FIG. 1 in an extended position.

FIG. 2 is a cross sectional view of the adjustable length and torque resistant golf shaft 20 of FIG. 1 in a fully extended position. As shown in FIG. 2, the shaft 20 in the fully extended position has an overall length 130 in accordance with one embodiment of approximately 37 inches, which includes the putter head 14. The putter head 14 will typically have an overall length 138 of approximately 3 inches. Furthermore, the adjustable shaft 20 has an overall length 132 of between 24 and 34 inches from the fully compressed or compacted position to the fully extended position.

Figure 3:
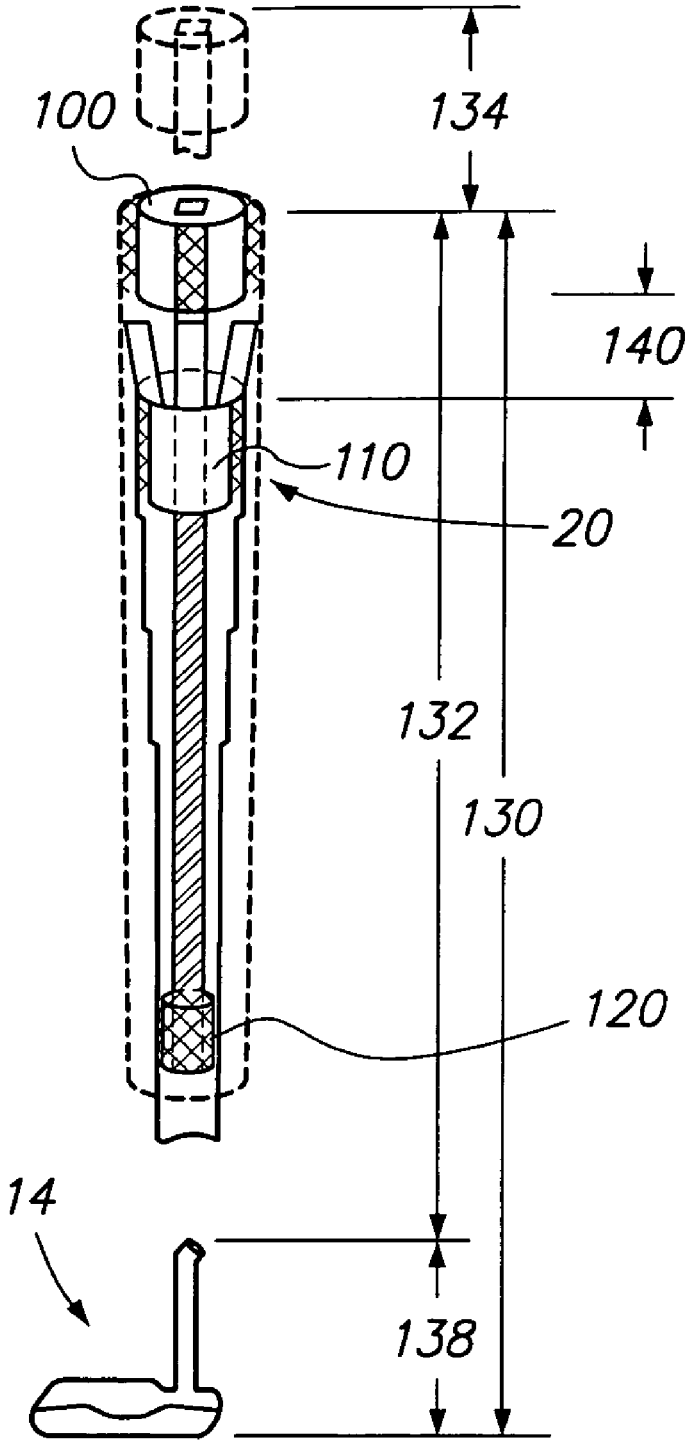
FIG. 3 is cross sectional view of the adjustable length and torque resistant golf shaft of FIG. 1 in a compressed position.

FIG. 3 is a cross sectional view of the adjustable length and torque resistant golf shaft 20 of FIG. 1 in a fully compressed or compacted position. As shown in FIG. 3, the shaft 20 compresses to an overall length 132 of approximately 24 inches in a preferred embodiment, and an overall length 130 of 27 inches including the putter head 14. The difference 134 between the extended position and the compressed or compact position is typically approximately 10 inches; however, it can be appreciated that the difference 134 can be more or less than 10 inches. As shown in FIG. 3, as the adjustable shaft 20 is compressed and/or extended, the distance 140 between the upper bushing 100 and the middle bushing 110 changes. For example, as the shaft 20 extends, the distance 140 between the upper bushing 100 and the middle bushing 110 increases. Alternatively, as the shaft 20 is compressed, the distance 140 between the upper bushing 100 and the middle bushing 110 decreases.

Figure 4:
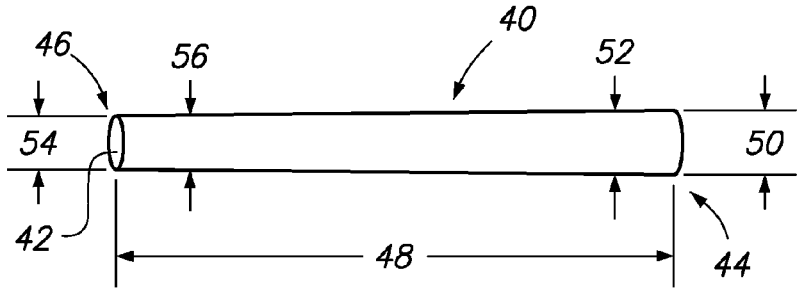
FIG. 4 is a perspective view of an upper shaft member of an adjustable length and torque resistant golf shaft.

FIG. 4 is a perspective view of an upper shaft member 40 of an adjustable length and torque resistant golf shaft 20. As shown in FIG. 4, the upper shaft member 40 is comprised of an essentially elongated cylindrical bore 42 having an upper end (or first end) 44 and a lower end (or second end) 46. The upper shaft member 40 has an overall length 48 of approximately 24 inches for a putter 10 having an overall length 130 of between 27 and 37 inches. The upper end 44 of the upper shaft member 40 preferably has an inner diameter 50 and an outer diameter 52 of approximately 0.550 and 0.580 inches, respectively. The lower end 46 of the upper shaft member 40 preferably has an inner diameter 54 and an outer diameter 56 of approximately 0.370 and 0.400 inches.

Figure 5:
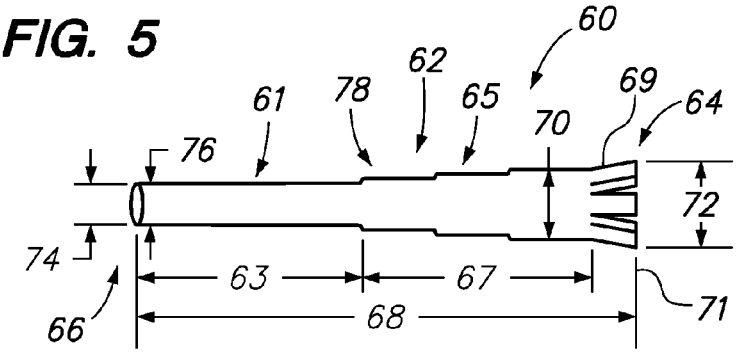
FIG. 5 is a perspective view of a lower shaft member of an adjustable length and torque resistant golf shaft.

FIG. 5 is a perspective view of a lower shaft member 60 of an adjustable length and torque resistant golf shaft 20. As shown in FIG. 5, the lower shaft member 60 is comprised of an essentially elongated cylindrical bore 62 having an upper end (or first end) 64 and a lower end (or second end) 66. The lower shaft member 60 can also include a stepped outer surface 78. The lower shaft member 60 includes a generally cylindrical lower portion 61, which extends for a distance 63 of approximately 12.5 inches, and an upper portion 65, which extends for a distance 67 of approximately 9 inches. The upper portion 65 has an outer diameter, which can increase in diameter in a series of annular steps. Each of the annular steps is preferably between 1 to 3 inches, and more preferably between 1.5 and 2.5 inches. Alternatively, it can be appreciated that the upper portion 65 can be configured without the stepped outer surface 78.

On the upper end 64 of the lower shaft member 60, the end 64 is flared and includes a plurality of flared members 69. The flared members 69 extend a distance 71 of approximately 0.5 inches. The lower shaft member 60 has an overall length 68 of approximately 22 inches for a putter 10 having an overall length 130 of between 27 and 37 inches. The upper end 64 of the lower shaft member 60 preferably has an inner diameter 70 and an outer diameter 72 of approximately 0.420 and 0.560 inches, respectively. The lower end 66 of the lower shaft member 60 preferably has an inner diameter 74 and an outer diameter 76 of approximately 0.320 and 0.365 inches. As shown in FIGS. 1 and 2, the upper end 64 of the lower shaft member 60 fits within the lower end 46 of the upper shaft member 40. As the shaft 20 extends in length, the lower shaft member 60 telescopes outward from the upper shaft member 40.

Figure 6:
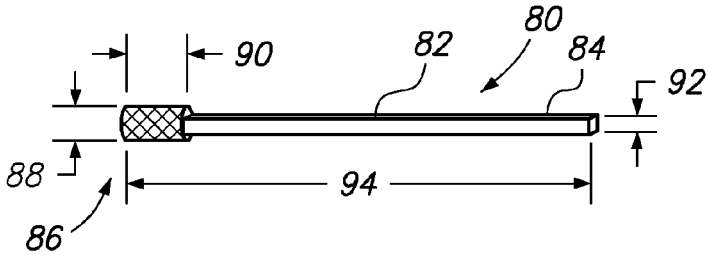
FIG. 6 is a perspective view of an inner rod with a plurality of bushings for an adjustable length and torque resistant golf shaft.

FIG. 6 is a perspective view of an inner rod 80 with a lower bushing 120 for an adjustable length and torque resistant golf shaft 20. As shown in FIG. 6, the inner rod 80 is comprised of a generally rectangular or square rod 82 having an upper end or first end 84 and a lower end or second end 86. On the lower end 86 of the rod 82, a lower bushing 120 is fixed thereto. The lower bushing 120 is generally cylindrical in shape and has an outer diameter 88 of approximately 0.240 inches and an overall length 90 of approximately 1.0 inches. The rod 82 can have any suitable cross sectional configuration and preferably has a thickness 92 of approximately 0.125 inches for a rectangular or square rod. The rod 82 preferably has an overall length 94 of approximately 16 to 24 inches, and more preferably an overall length 94 of 18 to 22 inches, and most preferably an overall length 94 of 22 inches. The rod 82 is preferably fixed to the upper and lower bushings 100, 120 and is allowed to slide upwards and downwards within an opening or bore 112 extending through a center portion the middle bushing 110.

Figure 7A:
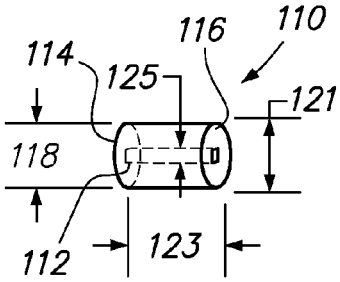
FIG. 7A is a perspective view of a middle bushing.

FIG. 7A is a perspective view of the middle bushing 110. As shown in FIG. 7, the middle bushing 110 is generally cylindrical in shape and includes an opening or bore 112 extending from a first end 114 to a second end 116. The first end 114 of the middle bushing has an outer diameter 118 of approximately 0.410 inches and an outer diameter 121 at the second end 116 of approximately 0.440 inches. The middle bushing 110 has an overall length 123 of approximately 1.0 inches. The opening or bore 112 preferably has a cross section configuration or diameter 125, which is essentially similar to that of the rod 82 of the inner rod 80. For example, for a square rod 82 having an outer diameter of 0.125 inches, the diameter 125 of the opening or bore 112, will preferably be approximately 0.125 inches or slightly larger to allow the rod to slide within the opening or bore 112 as the shaft 20 is extended or compressed.

Figure 7B:
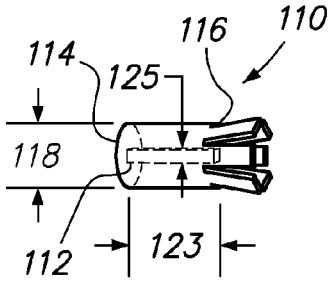
FIG. 7B is a perspective view of an alternative embodiment of the middle bushing.

FIG. 7B is a perspective view of an alternative embodiment of a middle bushing 110. The middle bushing 110 is generally cylindrical in shape and includes an opening or bore 112 extending from a first end 114 to a second end 116. The second end 116 of the bushing 110 as shown in FIG. 7B preferably includes a plurality of flared members 69. In addition, the opening or bore 112 preferably has a cross section configuration or diameter 125, which is essentially similar to that of the rod 82 of the inner rod 80.

Figure 8:
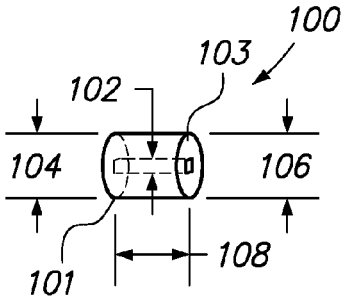
FIG. 8 is a perspective view of an upper bushing.

FIG. 8 is a perspective view of an upper bushing 100. As shown in FIG. 8, the upper busing 100 is generally cylindrical in shape and includes an opening or bore 102 extending from a first end 101 to a second end 103. The first end 101 of the upper bushing 100 has an outer diameter 104 of approximately 0.540 inches and an outer diameter 106 at the second end 103 of approximately 0.540 inches. The upper bushing 100 has overall length 108 of approximately 1.0 inches. As shown in FIG. 1, the upper bushing 100 is preferably fixed in the vicinity of the upper end of 44 of the upper shaft member 40.

Figure 9:
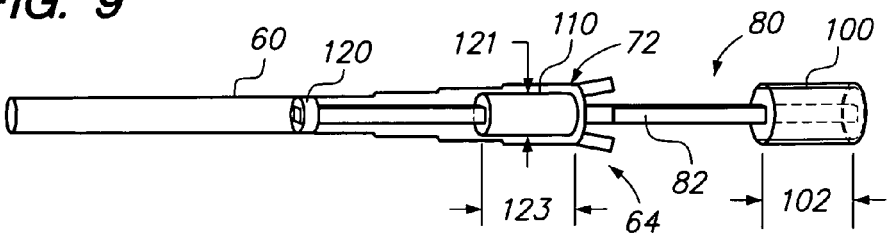
FIG. 9 is a perspective view of the lower shaft member and the inner rod.

FIG. 9 is a perspective view of the lower shaft member 60 and the inner rod 80. As shown in FIG. 9, the middle bushing 110 is fixed within an inner diameter 72 of the lower shaft member 60 near the upper end 64 with a suitable adhesive. The middle bushing 110 is fixed to the inner diameter 72, such that the rod 82 of the inner rod 80 can move freely in an up and down motion during expansion or compression of the shaft 20. In addition, it can be appreciated that as a result of the configuration of the opening or bore 112, the inner rod 80 does not rotate within the middle bushing 110. It can be appreciated that as a result of the locking configuration of the opening or bore 112 and the cross sectional configuration of the rod 82, the shaft 20 includes an anti-torquing or torque resistant feature. Furthermore, the inability of the rod 80 to rotate in connection with the inability of the upper and lower shaft members 40, 60 to rotate within the opening or bore 112 of the middle bushing 110, the shaft is torque resistant.

Figure 10:
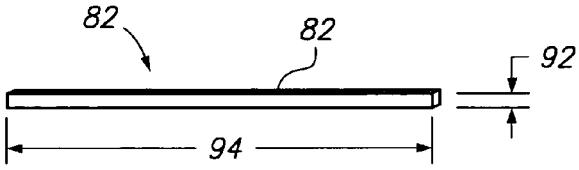
FIG. 10 is a perspective view of the inner rod.

FIG. 10 is a perspective view of the rod 82 portion of the inner rod 80. As shown in FIG. 10, the inner rod 80 includes a rod 82 having an overall length 94 of approximately 18 inches with a generally rectangular or square cross section 92.

Figure 11A:
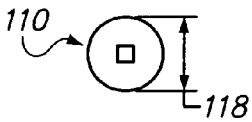
FIGS. 11A-11D are cross sectional views of a series of lower bushings adapted to receive an inner rod having various cross sectional configurations.
Figure 11B:
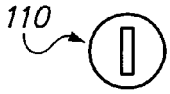
Figure 11C:
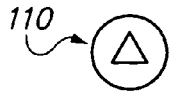
Figure 11D:
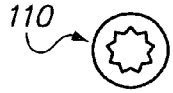

FIGS. 11A-11D are cross sectional views of a series of middle bushings 110 adapted to receive an inner rod 82 having various cross sections. As shown in FIGS. 11A-11D, it can be appreciated that the opening or bore within the middle bushing 110 can have any suitable configuration to match that of the rod 82 including square (FIG. 11A), rectangular (FIG. 11B), triangular (FIG. 11C) or star (FIG. 11D).

Figure 12A:
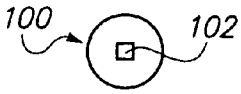
FIGS. 12A-12D are cross sectional views of a series of upper bushings adapted to receive an inner rod having various cross sectional configurations.
Figure 12B:
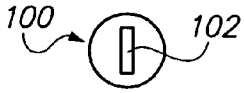
Figure 12C:
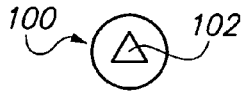
Figure 12D:
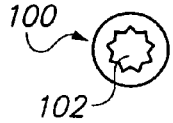

FIGS. 12A-12D are cross sectional views of a series of upper bushings 100 adapted to receive an inner rod 82 having various cross sections. As shown in FIGS. 12A-12D, it can be appreciated that the opening or bore 102 within the upper bushing 100 can have any suitable configuration to match that of the rod 82 including square (FIG. 12A), rectangular (FIG. 12B), triangular (FIG. 12C) or star (FIG. 12D).

Figure 13A:
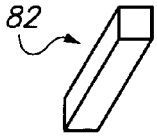
FIGS. 13A-13D are cross sectional views of a series of an inner rod having various cross sectional configurations.
Figure 13B:
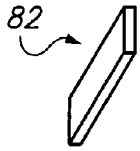
Figure 13C:
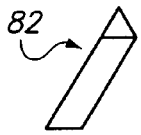
Figure 13D:
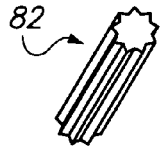

FIGS. 13A-13D are cross sectional views of a series of an inner rod 80 having various cross sectional configurations. As shown in FIGS. 13A-13D, it can be appreciated that the rod 82 can have any suitable cross sectional configuration to match that of the rod opening or bore within the upper and middle bushings 100, 110 including square (FIG. 13A), rectangular (FIG. 13B), triangular (FIG. 13C) or star (FIG. 13D).

Figure 14:
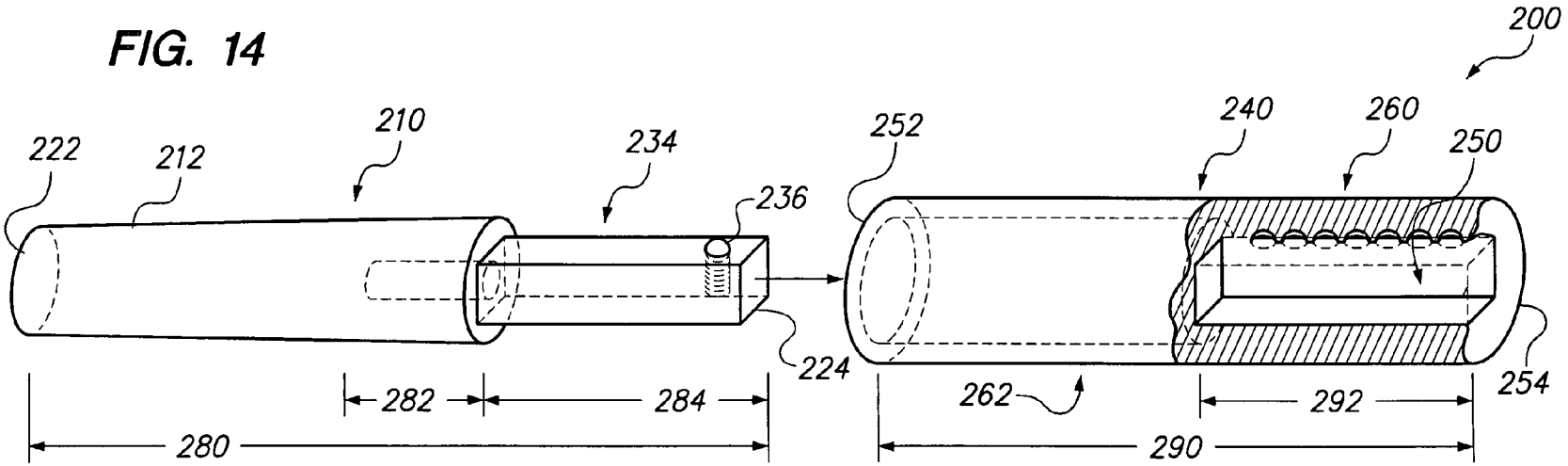
FIG. 14 is a perspective view of an adjustable length and torque resistant golf shaft according to another embodiment.

FIG. 14 is a perspective view of an adjustable length and torque resistant golf shaft 200 according to another embodiment. As shown in FIG. 14, the adjustable golf shaft 200 includes a lower shaft member 210 (or inner shaft member) and an upper or outer shaft member 240 (or outer shaft member). The lower shaft member 210 is comprised of an elongated cylindrical bore 212 with an inner rod member 220 attachable thereto. The upper shaft member 240 is comprised of an elongated outer cylindrical bore 262, which houses or contains an elongated cylindrical member 260 having an inner bore 250. The inner bore 250 is dimensioned to receive the inner rod member 220. The inner rod member 220 and the inner bore 250 are dimensioned to prevent the inner rod member 220 from rotating within the inner bore 250 forming a torque resistant golf shaft 200.

As shown in FIG. 14, the lower shaft member 210 is comprised of an essentially elongated cylindrical bore 212 having an upper end (or first end) 214 and a lower end (or second end) 216. The upper end or first end 214 of the cylindrical bore 212 is configured to receive the inner rod member 220. The inner rod member 220 includes a lower portion 232 and an upper portion 234. The upper portion 234 is configured or dimensioned to fit within the inner bore 250 of the upper shaft member 240. The lower portion 232 is configured or dimensioned to be received within the first end or upper end 214 of the elongated cylindrical bore 212. Overall, the inner shaft member 210 preferably extends for a distance 280 of approximately 15 to 30 inches and more preferably approximately 20 to 25 inches and most preferably approximately 22.50 inches with the upper shaft member 240 preferably extending for a distance of 290 of approximately 15 to 30 inches and more preferably approximately 20 to 25 inches and most preferably approximately 23.25 inches.

It can be appreciated that the lower shaft member 210 can also include a stepped or angled outer surface 216, wherein elongated cylindrical bore 212 preferably having a greater diameter at the upper or first end 214 as compared to the lower or second end 216. As shown in FIG. 14, the lower shaft member 210 includes a generally cylindrical lower portion 211, which extends for a distance 213 of approximately 19.0 inches, and an upper portion 215 of the lower shaft member 210, which extends for a distance of 284 of approximately 3.5 inches. The upper portion 215 of the lower shaft member 210 typically coincides with the upper portion 234 of the inner rod 220. However, it can be appreciated that the upper portion 234 of the inner rod member 220 can be configured to fit within the lower portion 211 of the elongated cylindrical bore 212. The elongated cylindrical bore 212 also includes a lower end or putter head end 222 dimensioned to receive a putter head shaft (not shown). As shown in FIG. 14, the inner rod member 220 includes a lower portion 232 dimensioned to be received within the upper end 214 of the lower bore member 212, and an upper portion 234 dimension to be received within an inner bore 250 of the inner bore member 260 of the upper shaft member 240.

The upper shaft member 240 is comprised of an elongated outer cylindrical bore 262, which houses an elongated cylindrical member 260 having an inner bore 250. The inner bore 250 is dimensioned to receive the inner rod member 220. As assembled, the inner rod member 220 and the inner bore 250 are dimensioned to prevent the inner rod member 220 from rotating within the inner bore 250 forming a torque resistant golf shaft 200. The upper shaft member 240 includes a lower end 252, which is configured to receive the inner rod member 220 of the lower shaft member 210 and an upper end 254. The upper end 254 preferably includes a handgrip (not shown), which circumscribes the upper most portion of the adjustable golf shaft 200. As shown in FIG. 14, the elongated outer cylindrical bore 262 extends from the lower end 252 to the upper end 254 for a distance 290 of approximately 15 to 30 inches and more preferably approximately 17.5 to 25 inches and most preferably about 23.25 inches. The elongated cylindrical member 260 is housed within the upper portion of the upper shaft 240. The elongated cylindrical member 260 preferably has a length 292 of approximately 10 to 18 inches and more preferably a length 292 of approximately 14.0 inches.

Figure 15:
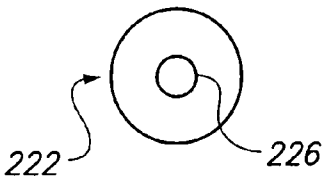
FIG. 15 is a cross sectional view of the lower end of lower shaft member of the adjustable length and torque resistant golf shaft of FIG. 14.

FIG. 15 is a cross sectional view of the lower end 216 of the lower shaft member 210 of the adjustable length and torque resistant golf shaft 200 of FIG. 14. As shown in FIG. 15, the lower end 216 of the lower shaft member 210 includes an opening or bore 226, which is dimensioned to receive a putter head shaft 18 (FIG. 1) of a putter head 14. It can be appreciated that the putter head 14 typically includes the putter head shaft 18 and a ball striking member 16.

Figure 16:
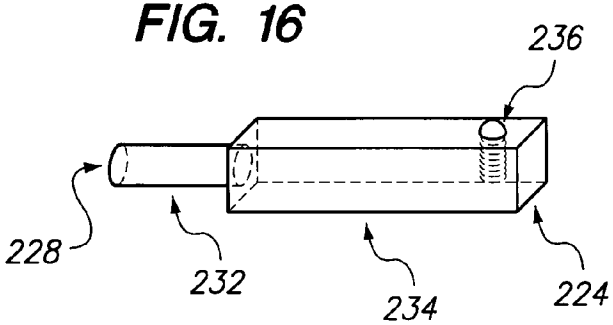
FIG. 16 is a perspective view of the inner rod of the lower shaft member of the adjustable length and torque resistant golf shaft of FIG. 14.

FIG. 16 is a perspective view of the inner rod member 220 of the lower shaft member 210 of the adjustable length and torque resistant golf shaft 200 of FIG. 14. As shown in FIG. 16, the inner rod member 220 includes a lower portion 232 and an upper portion 234. The lower portion 232 is preferably a cylindrical member 233 or other suitable shape having a cross sectional shape, which is configured to be fixed within an upper end 214 of the lower portion 211 of the lower shaft member 210. The upper portion 234 of the inner rod member 220 is dimensioned to be received within the inner bore 250 of the inner bore member 260 of the upper shaft member 240. The upper portion 234 and the inner bore 250 preferably having complimentary cross sectional configurations, wherein the upper portion 234 of the inner rod member 220 is configured to fit within the inner bore 250 in such a manner that the lower shaft member 210 does not rotate within the upper shaft member 240. The upper portion 234 of the inner rod member 220 also preferably includes a spring member 236 preferably having a ball mounted member 238 attached thereto, wherein the spring member 236 is configured to fit within the inner bore 250 of the upper shaft member 240. It can be appreciated that the spring member 236 can be replaced with any suitable device or system, which secures the inner rod member 220 within the inner bore 250 of the upper shaft member 240.

Figure 17:
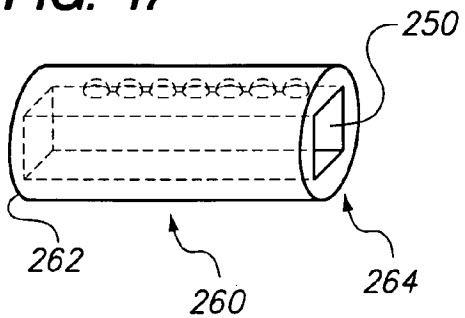
FIG. 17 is a perspective view of the inner bore member within the upper shaft member of the adjustable length and torque resistant golf shaft of FIG. 14.

FIG. 17 is a perspective view of the inner bore member 260 within the upper shaft member 240 of the adjustable length and torque resistant golf shaft 200 of FIG. 14. As shown in FIG. 17, the elongated cylindrical member 260 includes an inner bore 250, which is dimensioned to receive the upper portion 234 of the inner rod member 220 (FIG. 16). The elongated cylindrical member 260 is preferably positioned within an upper portion of the upper shaft member 240. The inner bore 250 can also include a series of ridges 270 having an upper portion 272 and a lower portion 274, which configured to receive the spring member 236 of the inner rod member 220. The series of ridges 270 allows the lower shaft member 210 and the inner rod member 220 to fit within the upper shaft member 240 and the inner bore 250, respectively, such that the lower shaft member 210 slides within the upper shaft member 240 during extension and compression of the shaft 200. The elongated cylindrical member 260 has a first end 262 and a second end 264, wherein a distance 292 from the first end 262 to the second end 264 is preferably approximately 14.0 inches long.

FIGS. 18A-18E are cross sectional views of a series of the inner rod member 220 of the lower shaft member 210 and the inner bore 250 within the upper shaft member 240. As shown in FIGS. 18A-18E, the inner bore 250 is configured to receive the upper portion 234 of the inner rod member 220 having various cross sectional configurations.

Figure 18A:
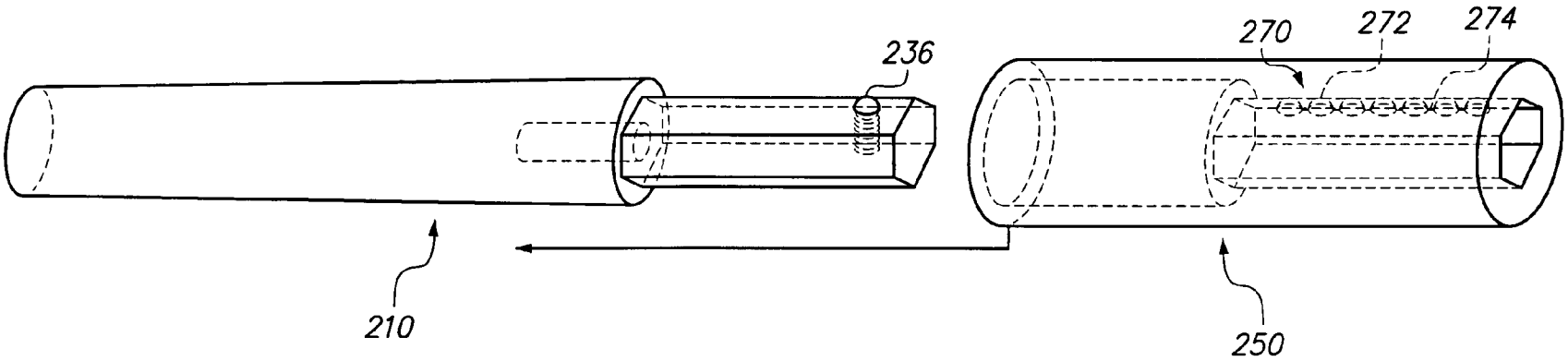
FIGS. 18A-18E are cross sectional views of a series of the upper portion of the inner rod member and the inner bore within the upper shaft member having various cross sectional configurations.
Figure 18B:
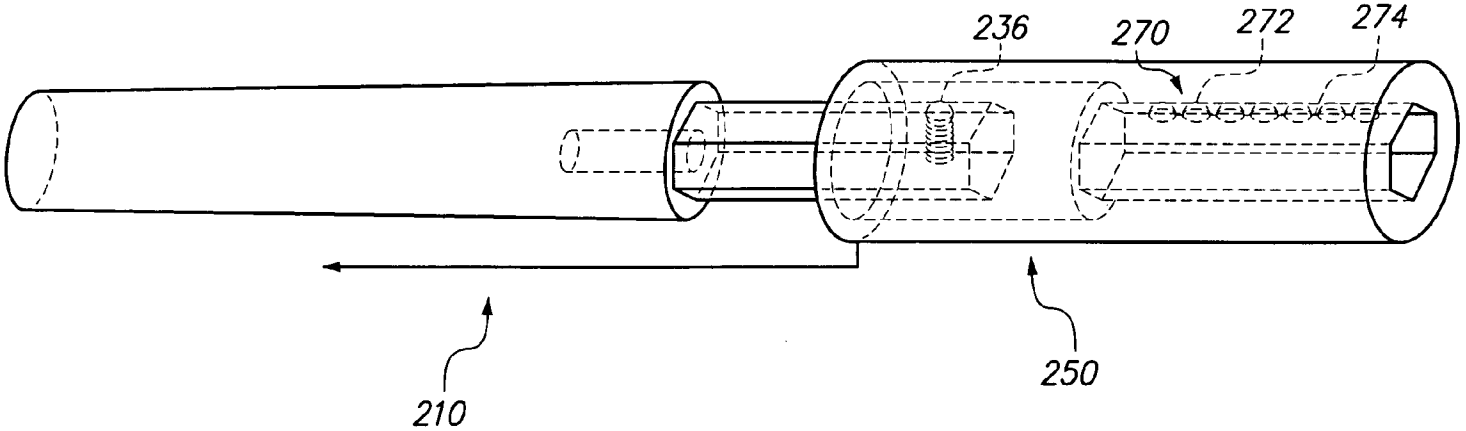
Figure 18C:
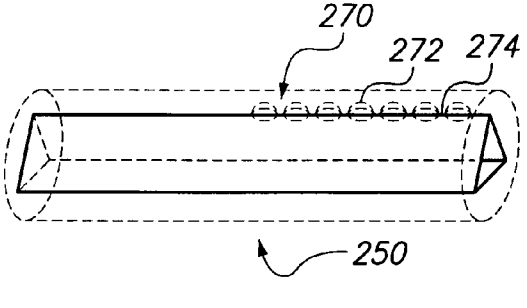
Figure 18C:
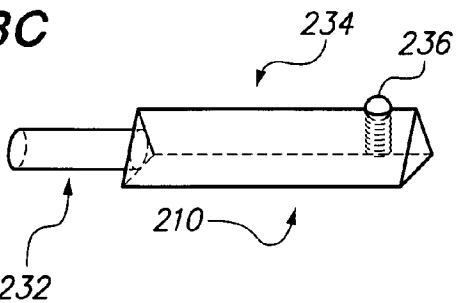
Figure 18D:
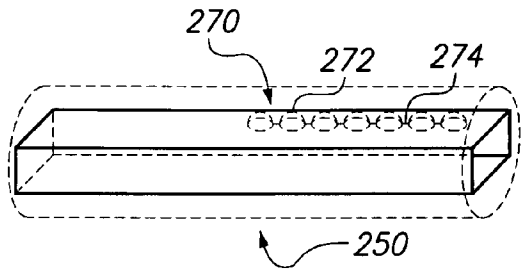
Figure 18D:
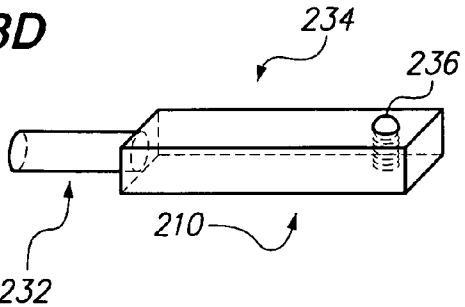

FIG. 18A shows a perspective view of the adjustable shaft member 200, including the lower shaft member 210 and the inner rod member 220, and the upper shaft member 240 and the elongated cylindrical member 260 and the inner bore 250. As shown in FIG. 18A, the inner rod member 220 and the inner bore 250 are complementary, such that the inner rod member 220 and the lower shaft member 210 does not rotate during use. In addition, the inner rod member 220 includes a spring member 236, which provides tension between inner rod member 220 and the inner bore 250 to prevent the lower shaft member 210 from sliding within the upper shaft member 240 during use.

Figure 18E:
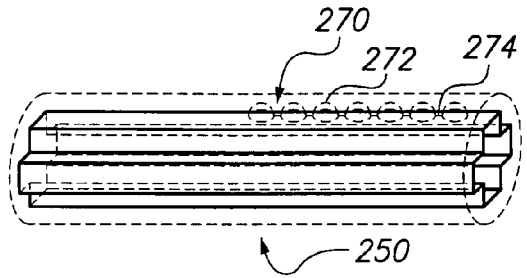
Figure 18E:
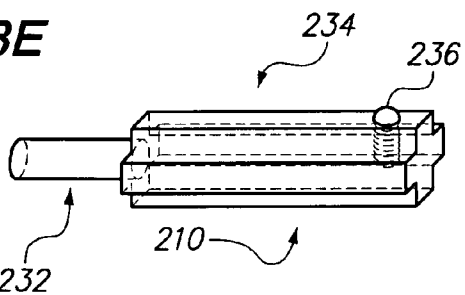

FIGS. 18B-18E are a series of perspective views of the inner rod member 220 and the inner bore 250 having various cross-sectional configurations. As shown in FIGS. 18B-18E, any suitable cross-sectional configuration can be used including a hexagon-like cross section (FIG. 18B), triangular (FIG. 18C), rectangular or square (FIG. 18D), or cross-like (FIG. 18E).

It will be understood that the foregoing description is of the preferred embodiments, and is, therefore, merely representative of the article and methods of manufacturing the same. It can be appreciated that variations and modifications of the different embodiments in light of the above teachings will be readily apparent to those skilled in the art. Accordingly, the exemplary embodiments, as well as alternative embodiments, may be made without departing from the spirit and scope of the articles and methods as set forth in the attached claims.

What is claimed is:

1. An adjustable golf shaft comprising:

an upper shaft member having an elongated bore therein with an upper bushing fixed within an upper end of the elongated bore therein;

a lower shaft member having an elongated bore therein with a middle bushing fixed within an upper end of the elongated bore therein, the upper end of the lower shaft member having a flared end, and wherein the flared end is configured to fit within an inner surface of the upper shaft member; and an inner rod having a lower bushings fixed to a lower end thereof, an upper end of the inner rod is fixed to the upper bushing, and the inner rod is adapted to slide within the middle bushing.

2. The shaft of claim 1, wherein a distance between the middle bushing and the upper bushing changes as the length of the shaft increases or decreases.

3. The shaft of claim 1, further comprising a putter head, wherein the putter head is attachable to a lower end of the lower shaft member.

4. The shaft of claim 1, further comprising a grip, the grip attached to an outer surface of the upper shaft member.

5. The shaft of claim 1, wherein the lower shaft member has a lower portion and an upper portion, the upper portion having a stepped portion, wherein the stepped portion results in the upper end of the lower shaft member having a greater outer diameter than an outer diameter of the lower end of the lower shaft member.

6. The shaft of claim 1, wherein the middle bushing has an elongated bore extending through the middle bushing, and wherein the bore is dimensioned to prevent the inner rod from rotating within the bore forming a torque resistant shaft.

* * * * *